US005603175A

United States Patent [19]

Brenner

[11] Patent Number: 5,603,175

[45] Date of Patent: Feb. 18, 1997

[54] GREETING TREE WITH GREETER

[76] Inventor: Margaret A. B. Brenner, 1917 Rookwood Rd., Silver Spring, Md. 20910

[21] Appl. No.: 390,027

[22] Filed: Feb. 17, 1995

[51] Int. Cl.[6] ..... G09F 1/10

[52] U.S. Cl. ..... 40/124.4

[58] Field of Search ..... 40/124.4, 546; 211/45, 189; 248/223.41, 225.11; D20/34, 43

[56] References Cited

U.S. PATENT DOCUMENTS

| | | | |
|---|---|---|---|
| 2,359,559 | 10/1944 | Horky | 40/546 X |
| 2,503,359 | 4/1950 | Smith | 40/124.4 |
| 3,529,798 | 9/1970 | Williams et al. | 248/223.41 X |
| 3,599,360 | 8/1971 | Lappo | 40/124.4 |
| 3,987,566 | 10/1976 | March | 40/124.4 |
| 4,186,503 | 2/1980 | Fontana | 40/124.4 |
| 4,212,445 | 7/1980 | Hagen | 248/223.41 X |
| 4,315,376 | 2/1982 | Eichenauer | 40/124.4 |

*Primary Examiner*—Joanne Silbermann
*Attorney, Agent, or Firm*—Grant Patent Services

[57] ABSTRACT

A greeting card, business card or money display with greeting disk assembly is disclosed herein that utilizes two flat pieces with beading and varying sizes of cuts and fit together to simulate a tree or pyramid and at the same time supports cards or money and a locked-on disk with imprinted greeting.

5 Claims, 2 Drawing Sheets

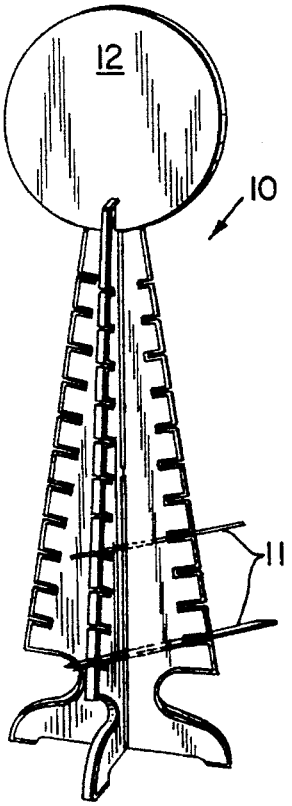
Fig. 1
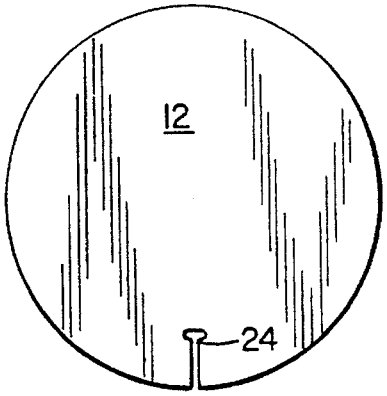
Fig. 3
Fig. 2
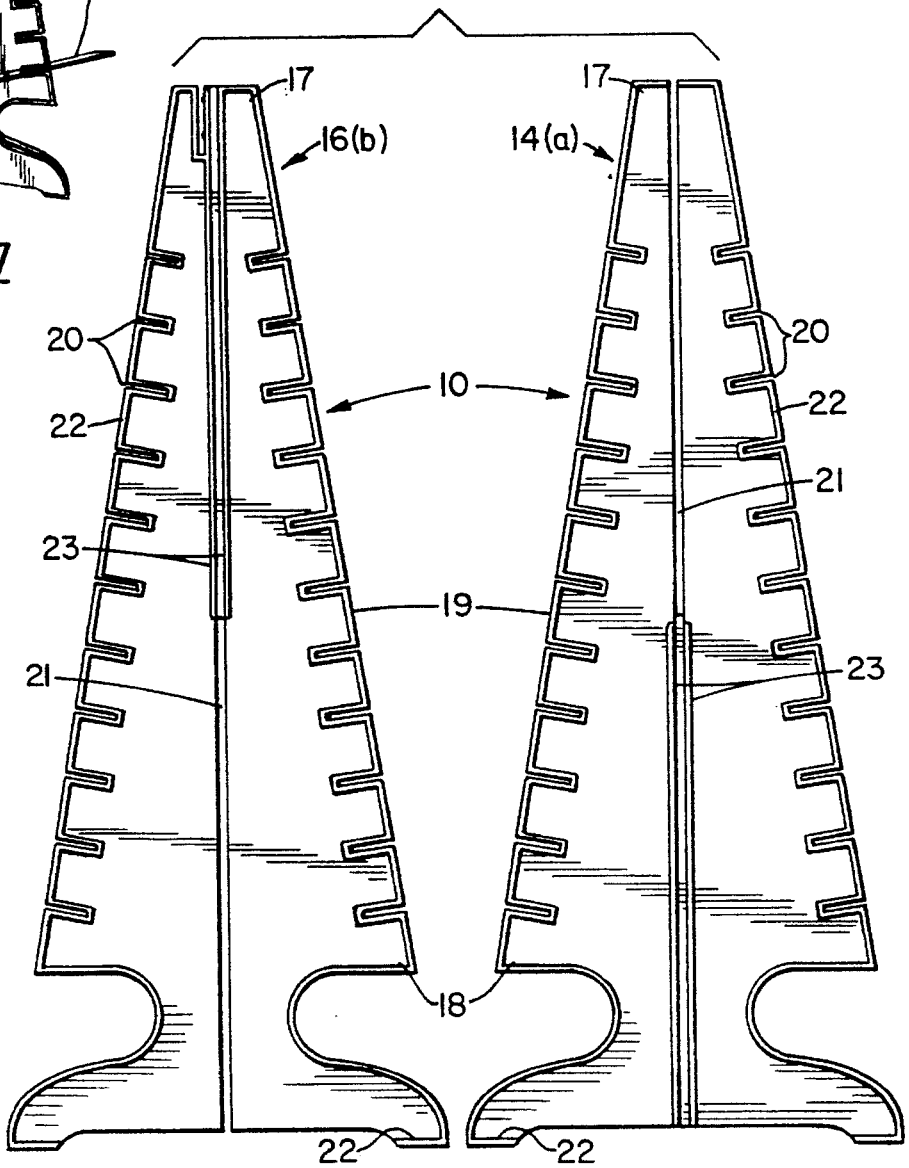

GREETING TREE WITH GREETER

BACKGROUND OF THE INVENTION

1. Field of the Invention

This invention relates generally to greeting and display devices for objects presented for manual selection and, more particularly, relates to a three-dimensional display and greeting device which is designed in a specific way to simulate a tree or pyramid.

2. Description of Prior Art

There have been a number of suggested ways of displaying greeting cards in the prior art as evidenced by the following U.S. Pat. Nos.: 4,315,376 (Eichenauer); 4,186,503 (Fontana); 3,987,566 (March); 3,599,360 (Lappo); and 2,503,359 (H. W. Smith).

Eichenauer is a tree-shaped display device comprising a plurality of structurally interrelated sheets of relatively rigid sheet material. Each of the plurality of sheets defines a number of card support slots at the outer portion thereof which are each adapted to receive a single greeting card so that a number of greeting cards are displayed for visual inspection.

Fontana is a greeting card display assembly utilizing a stack of straight slats mounted around a central post to simulate a Christmas tree in both two dimensions and three dimensions and, at the same time, supports greeting cards for display. An end cap in the shape of a Christmas tree is mounted around the top post section to prevent the slats from sliding off the post at its top end.

Lappo is a greeting card display having an upright pole upon which can be mounted several sets of branches or outwardly extending arms having mounting platforms at their outer extremities for mounting a plurality of greeting cards in an upright and slightly open position. The radius of the arms decreases from the bottom to the top of the structure to give it a tree-like shape. The top of the tree may be provided with an ornament.

March is a self-supporting, one-piece, collapsible device for holding greeting cards, particularly Christmas cards, to provide a decorative, Christmas tree-like display. The device is pyramidal in shape, the sidewalls of the device being foldable inwardly and downwardly for easy storage as well as easy extension to an uncollapsed, ready-to-use condition.

Smith discloses an ornamental tree display including a stand, a central core standard and a series of leaves to be positioned in spaced relationship about the center core. These leaves are provided for supporting greeting cards. A greeting card or the like may have its side or bottom portion slit providing a tongue which is insertable into the hollow top end of the central core standard.

All the patents cited disclosure different types of tree-shape structures. Fontana discloses an end cap to prevent the slats from sliding off its post, Lappo discloses an ornament that may be provided on the top of the tree Smith discloses how cards may be slit to insert into the hollow top of its central core standard. However, none of the cited patents discloses a greeting device assembly that is integral to, yet disengageably attached to, the card display device.

SUMMARY OF THE INVENTION

One object of the present invention is to provide a card display structure wherein a disk, or like shape, is disengageably connected to the top of the structure to provide space for a greeting, logo or other message.

Another object of the present invention is to provide a card display structure wherein a disk, or like shape, is disengageably locked onto the assembled structure to ensure that its message remains in place until the display structure is disassembled.

Another object of the present invention is to provide a card display structure wherein a choice of one or two disks, or like shapes, may be disengageably locked onto the assembled structure.

Another object of the present invention is to provide a card display structure wherein the disengageably connected disk or like shape, can be left off and a greeting card or business card can be placed in the vertical cut on the top of the display assembly.

Another object of the present invention is to provide a display assembly which simulates a Christmas tree or pyramid, while, at the same time, reliably supports greeting cards for display, business cards for display and selection or currency for display and presentation.

Yet another object of the present invention is to provide a card display structure which can be easily assembled and disassembled and which can be easily stored in a compact fashion.

As will be described in more detail hereinafter, the card display assembly disclosed herein and constructed in accordance with the present invention is one which utilizes two flat pieces of "tree" shape with a series of perpendicular cuts on each side, and a flat disc or similar shape with a "t" cut at its edge. The two "tree" shape pieces have slots cut half-way through their centers, one from the top, the other from the bottom. The disk fits securely onto the piece with the slot at the top. The piece then slides together with the piece with the slot at the bottom to form a three-dimensional assembly. Moreover, the cuts on the sides of the pieces are (1) parallel to each other when the pieces are assembled so that cards may be supported in two cuts, and (2) larger at the bottom and shorter at the top such that larger cards are placed toward the base of the assembly, and smaller cards toward the top to maintain a "tree" shape display.

BRIEF DESCRIPTION OF THE DRAWINGS

FIG. 1 is a perspective view of a card display with greeting device assembly which is constructed in accordance with the present invention and which is shown simulating a Christmas tree in three dimensions;

FIG. 2 is an elevated view of the two flat pieces, the first piece (a) and the second piece (b) that form the card display device of FIG. 1, illustrating the structure thereof in detail;

FIG. 3 is an elevated view of the flat disc that forms the greeting device of FIG. 1, illustrating the structure thereof in detail;

DESCRIPTION OF THE PREFERRED EMBODIMENTS

Figure 4:
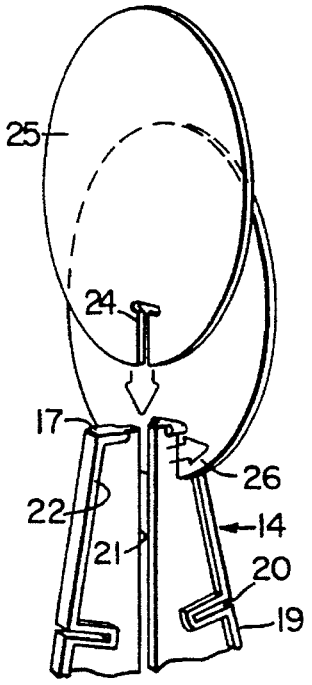
FIG. 4 is an isometric view illustrating the disc of FIG. 3 being positioned in primary assembly with the first piece (a) of FIG. 2.

Referring now to the drawings and first to FIG. 1, there is shown a card support structure generally at 10 which provides for support and display of a plurality of greeting cards illustrated in broken line at 11. The card support structure 10 is a three-dimensional form generally of the configuration of a Christmas tree, but may take other suitable forms within the spirit and scope of this invention. The Christmas tree effect is defined by a plurality of parallel cuts such that the cuts are longer and wider at the bottom of the piece and shorter and narrower at the top. The Christmas tree effect is further defined by the plurality of cuts in that the cuts support larger cards at the bottom of the assembly and smaller cards at the top. In FIG. 1 there is also shown a greeting device 12 which provides space for a greeting or logo wherein it stands above the display of cards.

As shown in FIG. 2, the card support structure 10 includes two flat pieces, first piece (a), 14, and second piece (b), 16, which are generally in the form of trapezoids having a top 17 and bottom 18 that are parallel and equal side portions 19 that extend upwardly from each side of the base edge 18 to the top edge 17. Each of the side portions 19 have a plurality of cuts 20 perpendicular to the sides thereof and equal distant from the bottoms of the pieces, such that the cuts are parallel to each other when the structure is assembled. A slot 21 is cut half-way through each piece and of a width equal to the width of the pieces, such slot being in the top of first piece (a) 14 and in the bottom of second piece (b) 16. Also shown in FIG. 2 is a raised edge 22 that outlines the side portions 19 wherein each cut has a raised edge. The raised edge extends across part of the top 17 and to the base of each of the pieces. A raised ridge 23 similar in size to the raised edge 22 extends from each comer of each slot 21 at the middle of each piece to the opposite edge of each piece such that raised ridges 23 form a groove in which the opposite piece fits. Each of the pieces of the card support device is formed of thermoplastic resin in a variety of colors.

Referring now to FIG. 3 there is shown a flat disk 12 wherein a t-shape 24 is cut out at the bottom edge. The flat surface of the disk serves as space for greetings or logos.

FIG. 4 shows the first step of the card display and greeting device assembly, wherein the greeting device is positioned 25 above the slot 21 of first piece (a) 14 just prior to being lowered and pressed 26 into position on first piece (a) 14. The disk cut 24 fits around the top 17 and raised edge 22 of first piece (a) 14.

Figure 5:
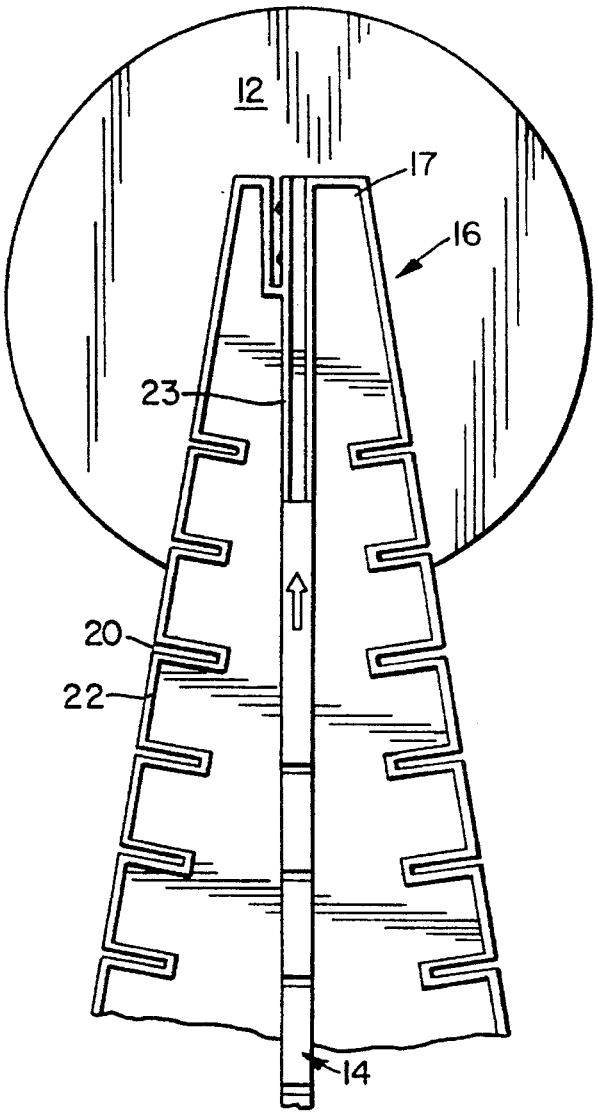
FIG. 5 is an isometric view illustrating the second piece (b) of FIG. 2 being positioned in assembly with the primary assembly structure of FIG. 4.

The completion of the card display and greeting device assembly is shown in FIG. 5. The slot 21 of second piece (b) 16 is positioned into the slot 21 of first piece (a) 14, subsequently the edge of the slot 21 of piece (a) 14 is positioned between the raised ridges 23 of the second piece (b) 16 and the edge of the slot 21 of the second piece (b) 16 is positioned between the raised ridges 23 of first piece (a) 14 as the pieces are slid together and the assembly is completed.

Many modifications and variations of the present invention are possible in light of the above teachings. It is, therefore, to be understood within the scope of the appended claims the invention may be protected otherwise than as specifically described.

What is claimed is:

1. A greeting card support structure with greeting disk assembly, comprising:

(a) a first tree shaped flat piece of the card support structure and a second tree shaped flat piece of the card support structure, said first tree shaped flat piece and said second tree shaped flat piece being positionable with respect to one another to form a three-dimensional card holder, said first tree shaped flat piece and said second tree shaped flat piece comprising:

(i) a first slot in a top half of the first tree shaped flat piece, and a second slot in a bottom half of said second tree shaped flat piece;

(ii) a double raised bead running from an end of said first slot and said second slot to an end of each of said tree shaped flat pieces, said beads forming a groove in which said first tree shaped flat piece and said second tree shaped flat piece fit together;

(iii) a plurality of cuts perpendicular to two sides of said first tree shaped flat piece and said second tree shaped flat piece, said plurality of said cuts being equidistant from the bottoms of said first tree shaped flat piece and said second tree shaped flat piece, such that the cuts are parallel to each other when said pieces are assembled and longer and wider at the bottom of said first and said second piece and shorter and narrower at the top of said first tree shaped flat piece and said second tree shaped flat piece;

(iv) a vertical cut at the top of the second tree shaped flat piece;

(v) an additional raised bead around the edge of said first tree shaped flat piece and said second tree shaped flat piece, including around each said cut; and (b) a flat disk with a t-shape cut in an edge thereof, mounted onto the top of the card support structure, such that the top of the t-shaped cut fits around the bead of the first tree shaped piece with the stem of the t-shaped cut fitting onto and around the flat part of said first tree shaped piece, placement of the disk on said structure being accomplished prior to sliding the first tree shaped flat piece and the second tree shaped flat piece of the structure together, wherein two said disks are capable of being placed n the structure, one on either side of the first slot.

2. An assembly according to claim 1, wherein the disk is disengageably connected with said first tree shaped flat piece of the structure such that the disk is locked into place, the disk shape is replaceable with any other shape appropriate to an occasion marked by use of the card structure assembly, and the disk is attachably removable to accommodate a card in said vertical cut.

3. An assembly according to claim 2, wherein said assembly maintains its shape and rigidity.

4. An assembly according to claim 3, further comprising a printed material selected from the group consisting of greeting cards, currency and business cards, supported between two adjacent said parallel cuts.

5. A method of displaying greeting cards and other printed matter, and comprising the steps of:

(a) providing a first tree shaped flat piece of a card support structure and a second tree shaped flat piece of the card support structure, said first tree shaped flat piece and said second tree shaped flat piece being positionable with respect to one another to form a three-dimensional card holder, said first tree shaped flat piece and said second tree shaped flat piece comprising:

(i) a first slot in a top half of the first tree shaped flat piece, and a second slot in a bottom half of said second tree shaped flat piece;

(ii) a double raised bead running from an end of said first slot and said second slot to an end of each of said tree shaped flat pieces, said beads forming a groove in which said first tree shaped flat piece and said second tree shaped flat piece fit together;

(iii) a plurality of cuts perpendicular to two sides of each said piece and equidistant from the bottoms of each of said tree shaped flat pieces, such that the cuts are parallel to each other and longer and wider at the bottom of the piece and shorter and narrower at the top;

(iv) a vertical cut at the top of the second tree shaped flat piece;

(v) an additional raised bead around the edge of said first tree shaped flat piece and said second tree shaped flat piece, including around each said vertical cut;

(b) mounting a flat disk with a t-shape cut in an edge thereof, mounted onto the top of the display such that a top of said t-shaped cut fits around the bead of the first tree shaped flat piece with a stem of the t-shaped cut fitting onto and around a flat part of said first tree shaped flat piece, placement of the disk on said holder being accomplished prior to sliding said first tree shaped flat piece and said second tree shaped flat piece of the holder together, wherein two said disks are capable of being placed on the card support structure, one on either side of the first slot;

(c) mounting said flat disk onto said first tree shaped flat piece prior to sliding the first tree shaped flat piece and said second tree shaped flat piece of the structure together such that the disk is locked in place; and (d) placing certain cards in said parallel cuts for support thereon so as to maintain a tree shape as the holder is filled, wherein said disk is disengageably connected with said first tree shaped flat piece, such that said disk can be left off the structure so as to accommodate a card in said vertical cut at the top of said second tree shaped flat piece, said card being placed in said vertical cut after the first tree shaped flat piece and the second tree shaped flat piece have been assembled, and said disk can be replaced with any other shape so long as the shape incorporates the t-shaped cut to fit around the bead and flat part of said first tree shaped flat piece.

* * * * *